US011189109B2

(12) United States Patent
Soda et al.

(10) Patent No.: US 11,189,109 B2
(45) Date of Patent: Nov. 30, 2021

(54) DATA COLLECTION DEVICE, DATA COLLECTION SYSTEM, AND DATA COLLECTION METHOD

(71) Applicant: DENSO TEN Limited, Kobe (JP)

(72) Inventors: Tomofumi Soda, Kobe (JP); Yoshitaka Hirashima, Kobe (JP); Tatsuya Hamaoka, Kobe (JP)

(73) Assignee: DENSO TEN Limited, Kobe (JP)

( * ) Notice: Subject to any disclaimer, the term of this patent is extended or adjusted under 35 U.S.C. 154(b) by 179 days.

(21) Appl. No.: 16/535,152

(22) Filed: Aug. 8, 2019

(65) Prior Publication Data

US 2020/0118355 A1 Apr. 16, 2020

(30) Foreign Application Priority Data

Oct. 16, 2018 (JP) ..... JP2018-195243

(51) Int. Cl.

| | |
|---|---|
| ***G07C 5/00*** | (2006.01) |
| ***G08G 1/133*** | (2006.01) |
| ***G08G 1/01*** | (2006.01) |
| ***G07C 5/08*** | (2006.01) |

(52) U.S. Cl.

CPC ..... *G07C 5/008* (2013.01); *G08G 1/0112* (2013.01); *G08G 1/133* (2013.01)

(58) Field of Classification Search

USPC ..... 701/32.3

See application file for complete search history.

(56) References Cited

U.S. PATENT DOCUMENTS

| | | | | |
|---|---|---|---|---|
| 2003/0216889 | A1* | 11/2003 | Marko | G07C 5/008 702/182 |
| 2005/0171660 | A1* | 8/2005 | Woolford | G08G 1/20 701/29.3 |
| 2015/0226563 | A1* | 8/2015 | Cox | G07C 5/00 701/29.1 |
| 2015/0228129 | A1* | 8/2015 | Cox | G01S 19/13 701/29.1 |
| 2018/0234496 | A1* | 8/2018 | Ratias | A63F 13/60 |
| 2020/0118020 | A1* | 4/2020 | Soda | G06N 7/005 |
| 2020/0118355 | A1* | 4/2020 | Soda | G08G 1/133 |

FOREIGN PATENT DOCUMENTS

JP 2018-055581 A 4/2018

* cited by examiner

*Primary Examiner* — Tyler D Paige
(74) *Attorney, Agent, or Firm* — Oliff PLC

(57) ABSTRACT

A data collection apparatus includes: a collection unit which collects data relating to respective vehicles from vehicular devices installed in the respective vehicles; a reception unit which receives a prescribed communication amount specified; and a providing unit which provides a user interface that provides guidance on manipulations for specifying a data collection condition so that a communication amount of data collected by the collection unit falls within the specified communication amount.

20 Claims, 14 Drawing Sheets

FIG. 4A

| PARAMETER | SYMBOL | THRESHOLD VALUE |
|---|---|---|
| VEHICLE SPEED | > | 60km/h |

FIG. 4B

PRIORITY RANK C

| ITEM | SPECIFIED VALUE | DEGREE OF RELATION |
|---|---|---|
| PARAMETER | VEHICLE SPEED | - |
| | ACCELERATION | A |
| | BRAKE PRESSURE | C |
| | ENGINE ROTATION SPEED | B |
| | ENGINE OIL TEMPERATURE | F |

PRIORITY RANK A

| ITEM | SPECIFIED VALUE | DEGREE OF RELATION |
|---|---|---|
| SYMBOL | > | – |
| | ≥ | △ |
| | = | × |
| | < | × |
| | ≤ | × |

PRIORITY RANK B

| ITEM | SPECIFIED VALUE | DEGREE OF RELATION |
|---|---|---|
| THRESHOLD VALUE | 60 | – |
| | 50 | △ |
| | 40 | × |
| | 70 | △ |
| | 80 | × |

DATA COLLECTION DEVICE, DATA COLLECTION SYSTEM, AND DATA COLLECTION METHOD

CROSS-REFERENCE TO RELATED APPLICATIONS

This application is based on and claims priority under 35 USC 119 from Japanese Patent Application No. 2018-195243 filed on Oct. 16, 2018.

TECHNICAL FIELD

An embodiment of the present disclosure relates to a data collection apparatus, a data collection system, and a data collection method.

BACKGROUND ART

Data collection apparatus are known that collect road information from vehicular devices installed in respective vehicles. These data collection apparatus collect road information at desired positions by selecting vehicles as road information collection targets on the basis of pieces of position information of the respective vehicles (refer to JP-A-2018-055581, for example).

SUMMARY OF INVENTION

However, the above-described conventional technique has room for improvement in allowing a user to set parameters for information collection easily while recognizing a communication amount.

More specifically, in the above-described conventional technique, a user can connect a terminal to a center apparatus and specify an upload condition etc. in a desired manner through a user interface on the center apparatus. This contributes to, among other things, flexible information collection that is suitable for a situation and reduction of the amount of communication. However, on the other hand, it has problems that the user has difficulty recognizing the amount of communication and cannot set parameters easily.

One aspect of an embodiment has been made in view of the above, and hence its object is to provide a data collection apparatus, a data collection system, and a data collection method that allow a user to set parameters for information collection easily while recognizing a communication amount.

A data collection apparatus according to the one aspect of the embodiment is equipped with a collection unit, a reception unit, and a providing unit. The collection unit collects data relating to respective vehicles from vehicular devices installed in the respective vehicles. The reception unit receives a prescribed communication amount specified. The providing unit provides a user interface that provides guidance on manipulations for specifying a data collection condition so that a communication amount of data collected by the collection unit falls within the specified communication amount.

The one aspect of the embodiment allows a user to set parameters for information collection easily while recognizing a communication amount.

BRIEF DESCRIPTION OF DRAWINGS

FIG. 4A is a first drawing for description of a similar condition search operation.

FIG. 4B is a second drawing for description of the similar condition search operation.

DETAILED DESCRIPTION OF THE INVENTION

A data collection apparatus, a data collection system, and a data collection method according to an embodiment of the present disclosure will be hereinafter described in detail with reference to the accompanying drawings. The present invention is not limited to the embodiment described below.

First, the data collection method according to the embodiment will be outlined with reference to FIGS. 1A-1H. FIGS. 1A-1H are first to eighth drawings for outlining the data collection method according to the embodiment. The data collection method according to the embodiment will be described below with reference to FIGS. 1A-1H using an example data collection system 1 to which it is applied.

Figure 1A:
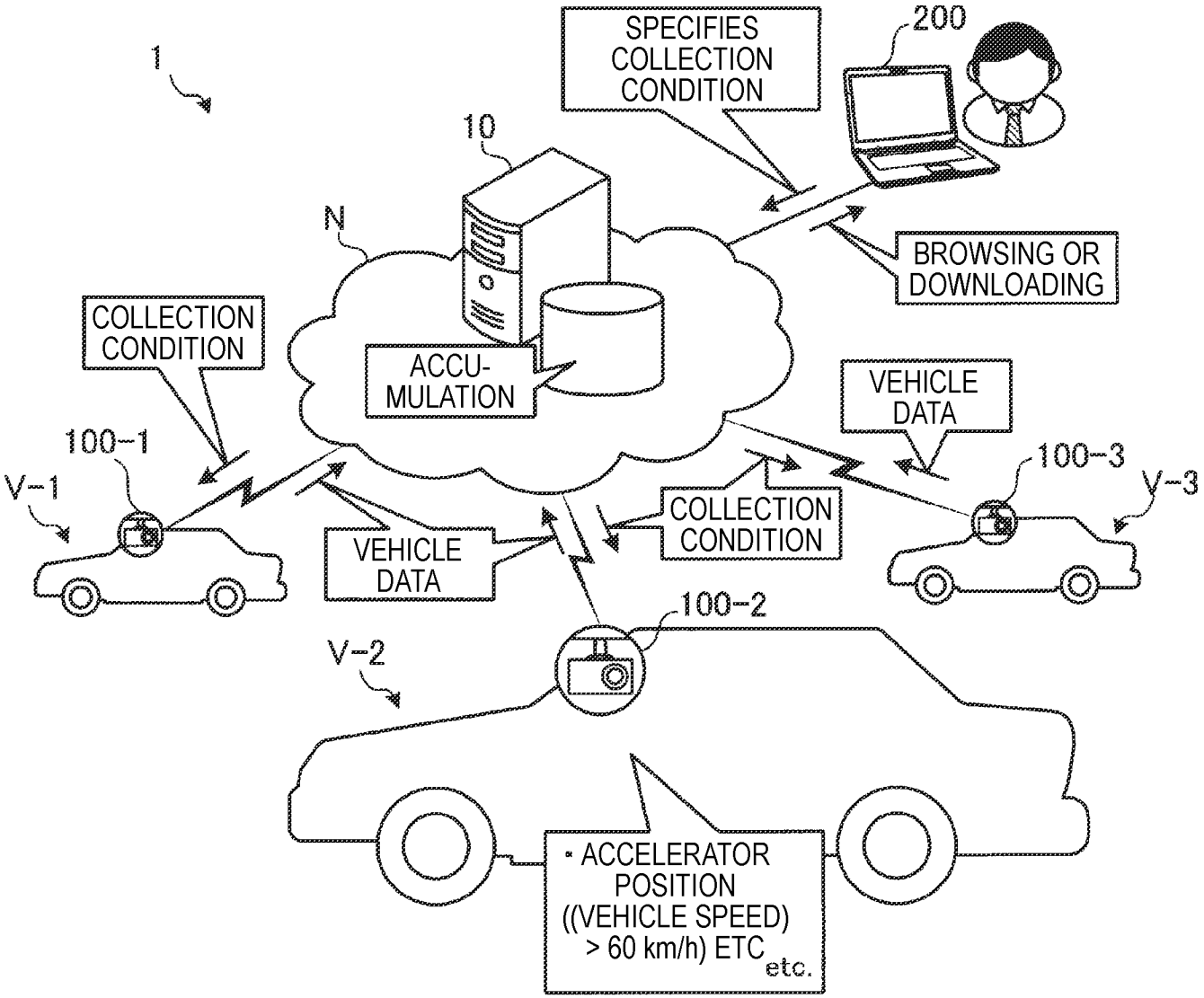
FIG. 1A is a first drawing for outlining a data collection method according to an embodiment.

As shown in FIG. 1A, the data collection system 1 according to the embodiment includes a data collection apparatus 10, vehicular devices 100-1, 100-2, 100-3, . . . that are installed in respective vehicles V-1, V-2, V-3, . . . , and a user terminal 200.

The data collection apparatus 10, which is implemented as, for example, a cloud server that provides a cloud service over a network N such as the Internet or a cellphone network, receives a vehicle data collection request from a data user, collects vehicle data from the respective vehicular devices 100 on the basis of the received collection request, and provides collected vehicle data to the data user.

Each vehicular device 100, which is, for example, a drive recorder having a camera, various sensors such as an acceleration sensor and a GPS (global positioning system) sensor, a storage device, a microcomputer, etc., picks up vehicle data that comply with a collection request received by the data collection apparatus 10.

Each vehicular device 100 uploads picked-up vehicle data to the data collection apparatus 10 when appropriate. Using a drive recorder also as vehicular device 100 in this manner enables effective use of vehicular components installed in each vehicle V. Alternatively, a vehicular device 100 and a driver recorder may be used as separate devices.

The user terminal 200, which is a terminal that is used by the data user, is, for example, a notebook PC (personal computer), a desk-top PC, a tablet terminal, a PDA (personal digital assistant), a smartphone, or a wearable device such as glasses-type or wrist-watch-type information processing terminal.

For example, the data user is a developer who develops an autonomous drive technique on the basis of vehicle data provided by the data collection apparatus 10. The data collection apparatus 10 provides such a data user with user interface (hereinafter abbreviated as "UI") pictures on the user terminal 200.

As shown in FIG. 1A, the data user specifies a vehicle data collection condition via such a UI picture. In response, the data collection apparatus 10 distributes the specified collection condition to each vehicle V in a file form, for example.

Figure 1B:
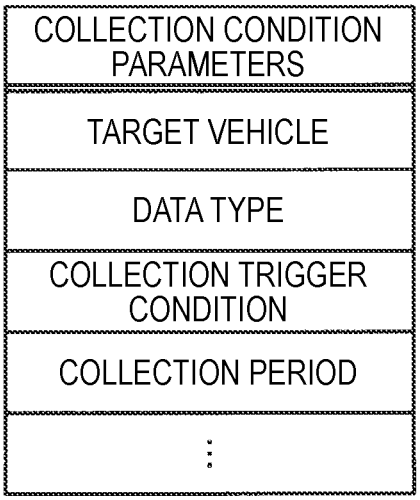
FIG. 1B is a second drawing for outlining the data collection method according to the embodiment.

As shown in FIG. 1B, the collection condition includes various parameters relating to collection of vehicle data. As shown in FIG. 1B, the various parameters are, for example, "target vehicle," "data type," "collection trigger condition," "collection period," etc.

"Target vehicle" is an identifier of a vehicle V as a collection target. "Data type" is a type of collection target data such as an acceleration position. "Collection trigger condition" is a condition as a trigger of collection and is, for example, a condition that the vehicle speed has exceeded a prescribed speed.

For example, in the example of FIG. 1A, for the vehicular device 100-2 of at least the vehicle V-2, a collection condition is specified to collect data of the data type "accelerator position" using the collection trigger condition "(vehicle speed)>60 km/h."

Each vehicular device 100 uploads vehicle data picked up in the vehicle V to the data collection apparatus 10 with proper timing, and the data collection apparatus 10 stores the received vehicle data. The data user browses or downloads vehicle data accumulated in the data collection apparatus 10, for example, via a UI picture mentioned above.

Figure 1C:
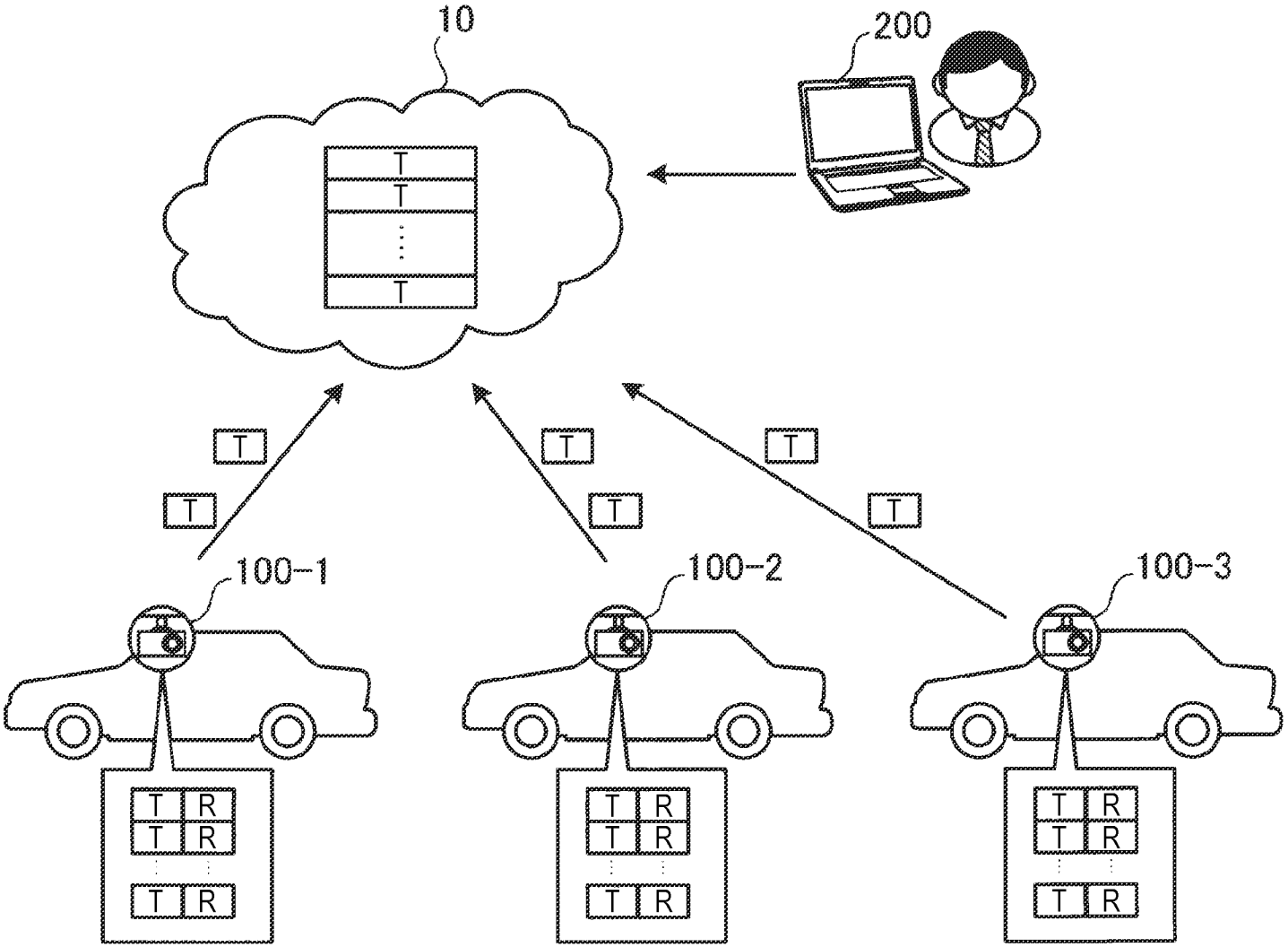
FIG. 1C is a third drawing for outlining the data collection method according to the embodiment.

To describe the data collection method more specifically, a series of steps according to which vehicle data is provided to the data user in the data collection system 1 will be described with reference to FIGS. 1C-1E. First, as shown in FIG. 1C, the data user specifies a collection condition using the user terminal 200 which is connected to the data collection apparatus 10.

In this operation, the data collection apparatus 10 generates data for generation of tag data T having characteristics of index data to be attached to real data R to be collected and to be used for searching for or recognizing its outline. Data for generation of such tag data T is generated by manipulations by the data user using a program and data stored in the user terminal 200 or the data collection apparatus 10.

The specified collection condition and the generated data for generation of tag data T are stored in the data collection apparatus 10 and delivered to vehicles V as data collection targets and stored in their vehicular devices 100.

Each vehicular device 100 monitors output data of various sensors. If an event that satisfies the stored collection condition has occurred, the vehicular device 100 stores its real data R in a storage device. Furthermore, each vehicular device 100 generates tag data T corresponding to the real data R on the basis of the stored data for generation of tag data T and the real data, and stores the generated tag data T. Each vehicular device 100 uploads the generated tag data T to the data collection apparatus 10 and the data collection apparatus 10 stores the received tag data T. At this time, the real data R is not uploaded to the data collection apparatus 10.

When the data user connects the user terminal 200 to the data collection apparatus 10 to check a data collection status or collect real data R, meta information that is based on tag data T collected by the data collection apparatus 10 is displayed on the user terminal 200. At the same time, UI picture for allowing manipulations for collecting real data R corresponding to each piece of tag data T.

Figure 1D:
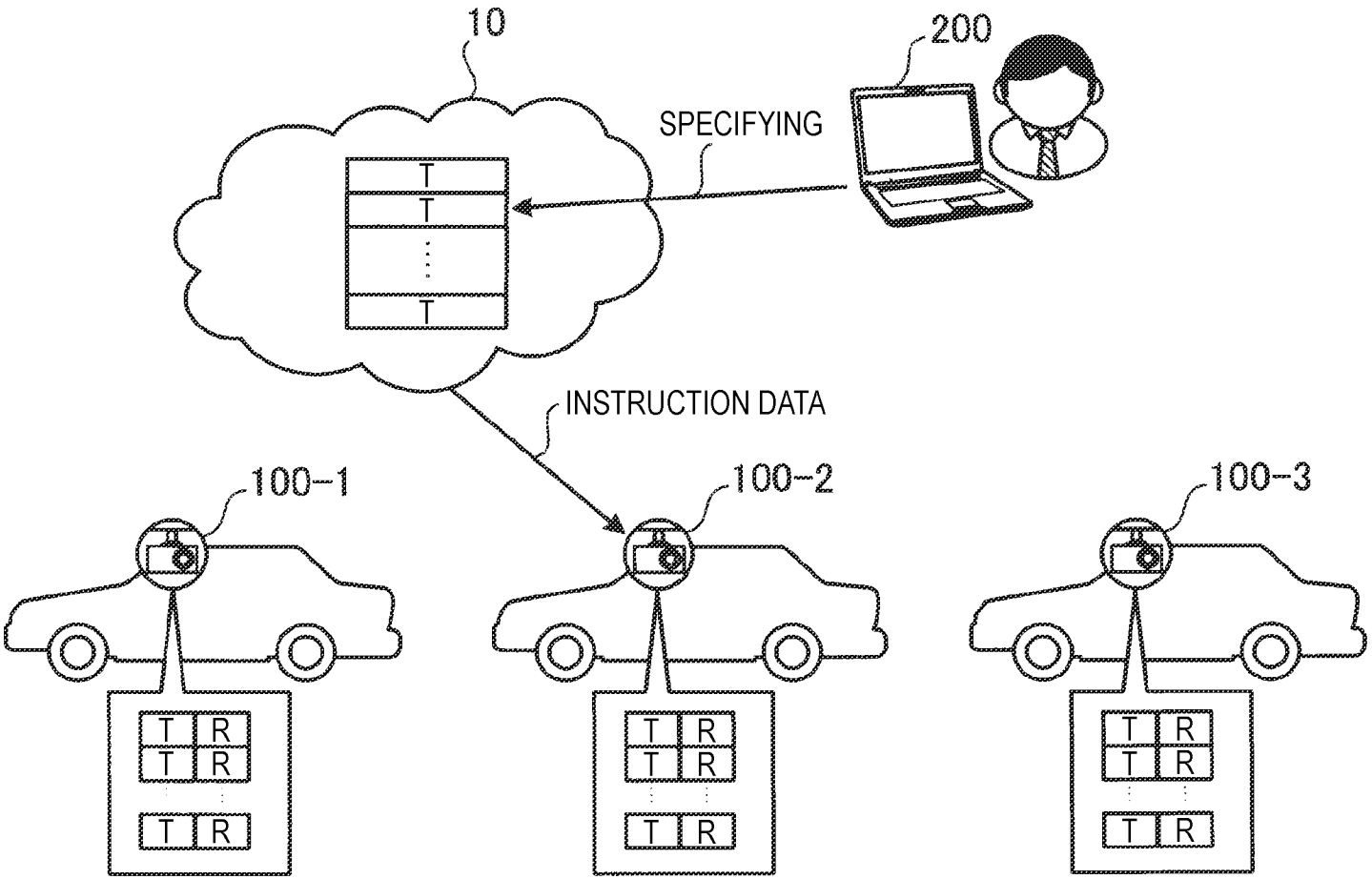
FIG. 1D is a fourth drawing for outlining the data collection method according to the embodiment.

When as shown in FIG. 1D the data user specifies tag data T corresponding to real data R to be collected through the user terminal 200, instruction data that specifies the real data R is transmitted from the data collection apparatus 10 to the vehicular device 100 concerned.

Figure 1E:
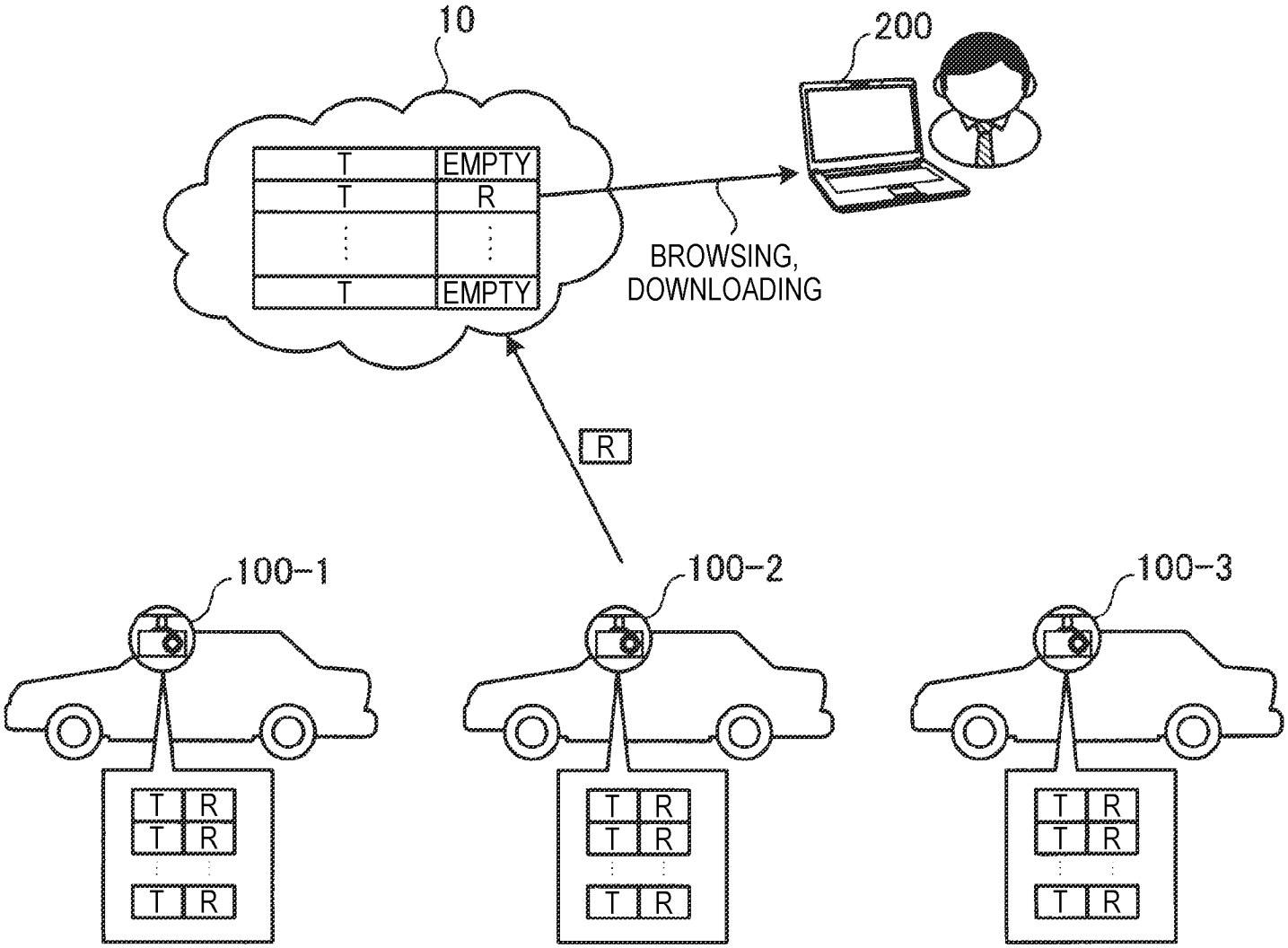
FIG. 1E is a fifth drawing for outlining the data collection method according to the embodiment.

Then, as shown in FIG. 1E, the specified real data R is uploaded from each vehicular device 100 to the data collection apparatus 10 and stored therein. From the user terminal 200, the data user browses or downloads, for example, the real data R stored in the data collection apparatus 10 by accessing them.

From the viewpoint of the data capacity of each vehicular device 100, it is preferable that real data R and corresponding tag data R that have been uploaded to the data collection apparatus 10 be deleted from the vehicular device 100 after their uploading to the data collection apparatus 10.

It is preferable that tag data T not be data obtained by simply extracting part of real data R but be data that is converted into meta information to such an extent as to allow the data user to recognize an outline of the real data R and to judge whether the real data R is necessary when referring to the tag data T.

Incidentally, by collecting, stepwise, such tag data T and real data R selected on the basis of the tag data T, the data collection system 1 need not always collect all real data R and can thereby reduce the amount of communication. On the other hand, the fact that the data user can specify the above-mentioned collection condition parameters in a desired manner means that the amount of communication varies every time the collection condition is changed and the data user has difficulty recognizing an amount of communication.

Figure 1F:
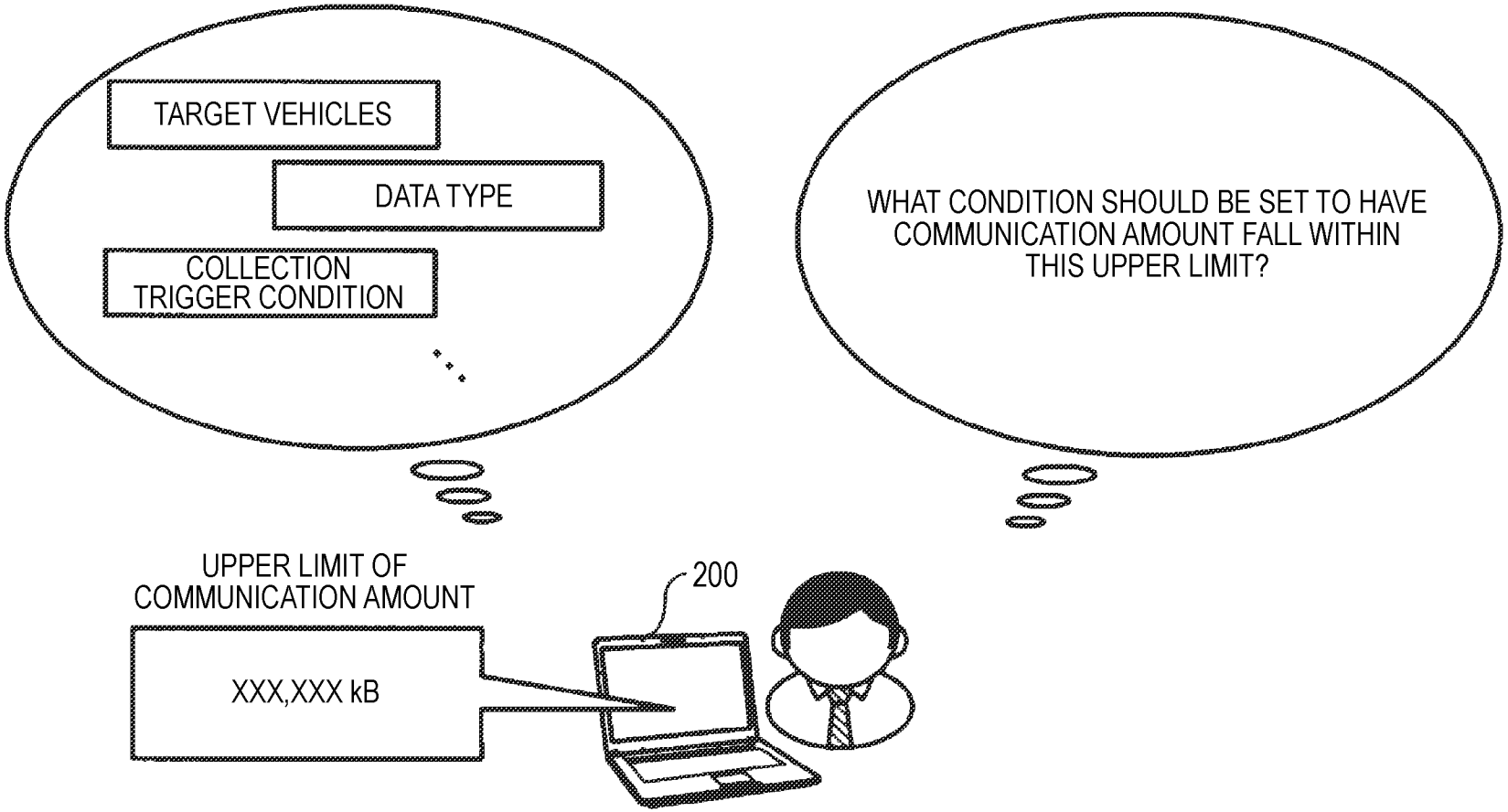
FIG. 1F is a sixth drawing for outlining the data collection method according to the embodiment.

That is, as shown in FIG. 1F, even if the data user wants to make the amount of communication smaller than a desired upper limit, it is difficult for him or her to judge how to adjust various parameters. In the following, an upper limit communication amount does not mean a physical upper limit communication amount that is determined by a communication environment but means a desired communication amount that is specified by the data user.

Thus, in the data collection method according to the embodiment, when the data collection apparatus 10 has received a desired upper limit communication amount specified by the data user, the data collection apparatus 10 provides a UI picture for guiding the data user in making manipulations for setting a collection condition so that the amount of communication falls within that upper limit.

Figure 1G:
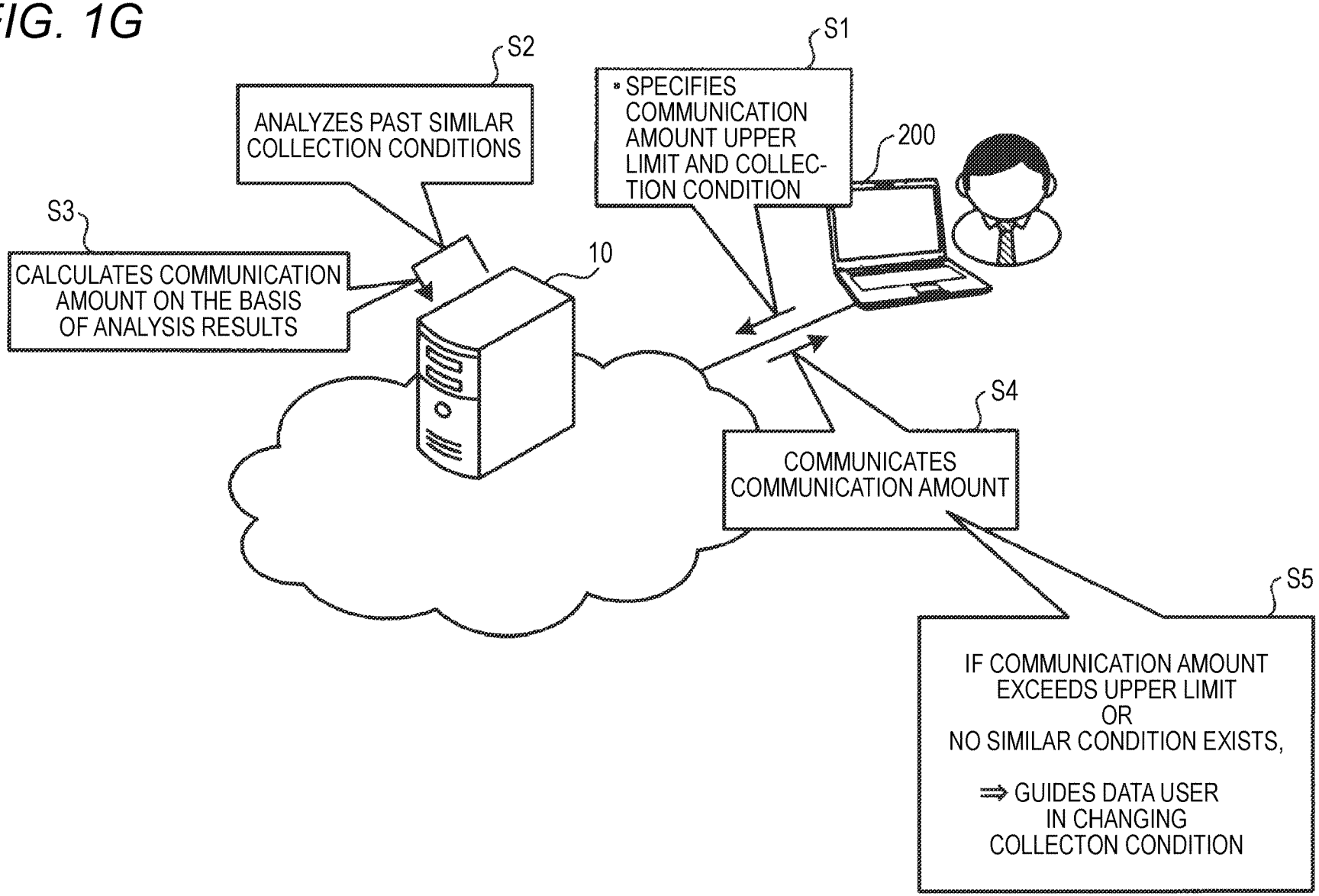
FIG. 1G is a seventh drawing for outlining the data collection method according to the embodiment.

More specifically, in the data collection method according to the embodiment, first, at step S1, as shown in FIG. 1G the data user specifies a "communication amount upper limit" and a "collection condition" via the user terminal 200. Receiving the communication amount upper limit and the collection condition, the data collection apparatus 10 analyzes past similar collection conditions (hereinafter referred to as "similar conditions") at step S2 and calculates a communication amount on the basis of analysis results at step S3.

At step S4, the data collection apparatus 10 informs the user terminal 200 of the calculated communication amount. If the calculated communication amount exceeds the specified upper limit or there is no similar condition, at step S5 the data collection apparatus 10 guides the data user in changing the collection condition.

Figure 1H:
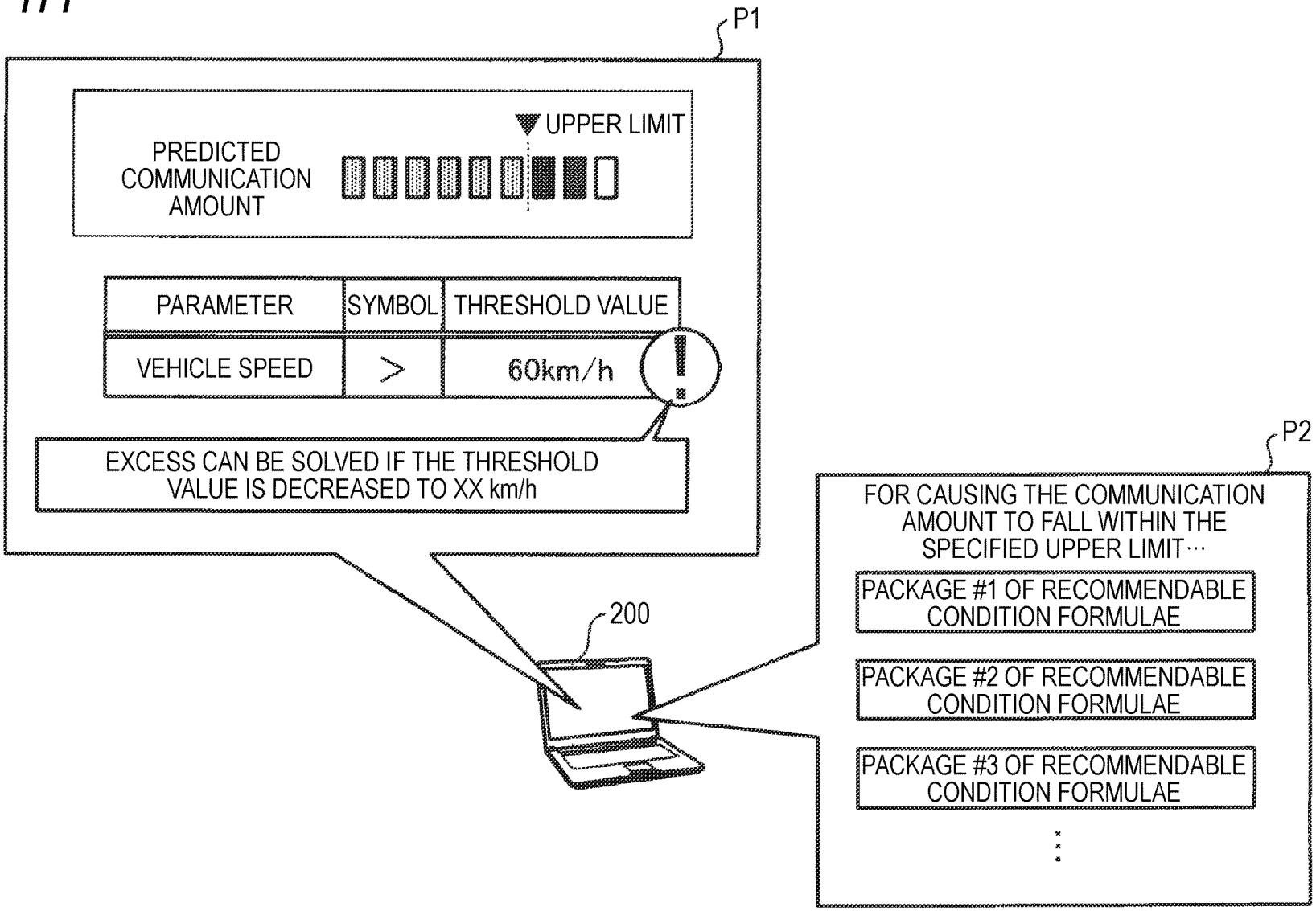
FIG. 1H is an eighth drawing for outlining the data collection method according to the embodiment.

More specifically, as shown in FIG. 1H, the data collection apparatus 10 provides the user terminal 200 with a UI picture for guidance on changing of the collection condition. For example, the data collection apparatus 10 causes the user terminal 200 to display an indicator indicating a relationship between the specified upper limit and a predicted communication amount as part of a pattern P1 shown in FIG. 1H. In the example shown in FIG. 1H, the predicted communication amount is displayed in green in its portion on the left of the upper limit and in red in its portion on the right of the upper limit. It is preferable that such an indicator be varied in real time according to the specified contents of the collection condition. The indicator is just an example and other various modes may be employed such as a graph, a numerical expression, and a non-numerical expression. Although in this example both of the specified upper limit and the predicted communication amount are displayed, only the predicted communication amount may be displayed. As a further alternative, the difference between them may be displayed.

As shown in the pattern P1 in FIG. 1H, for example, the data collection apparatus 10 urges the data user to input a condition having a proper value by causing display of a guidance message such as "Excess can be solved if the threshold value is decreased to XX km/h together with an exclamation mark as a warning adjacent to the condition formula specified by the data user.

The data collection apparatus 10 may search, in advance, past results etc. for similar conditions under which the communication amount falls within the upper limit specified by the data user and display packages of recommendable condition formulae in the form of a list as a pattern P2. If the data user selects a desired package from the list, the collection condition can be changed easily so as to reflect the contents of the selected package.

As described above, in the data collection method according to the embodiment, when receiving a desired communication amount upper limit specified by the data user, the data collection apparatus 10 provides a UI picture for guidance on changing of the collection condition.

As a result, the data collection method according to the embodiment allows the data user to set parameters for information collection easily while recognizing a communication amount.

The configuration of the data collection system 1 according to the embodiment will be hereinafter described in more detail.

Figure 2:
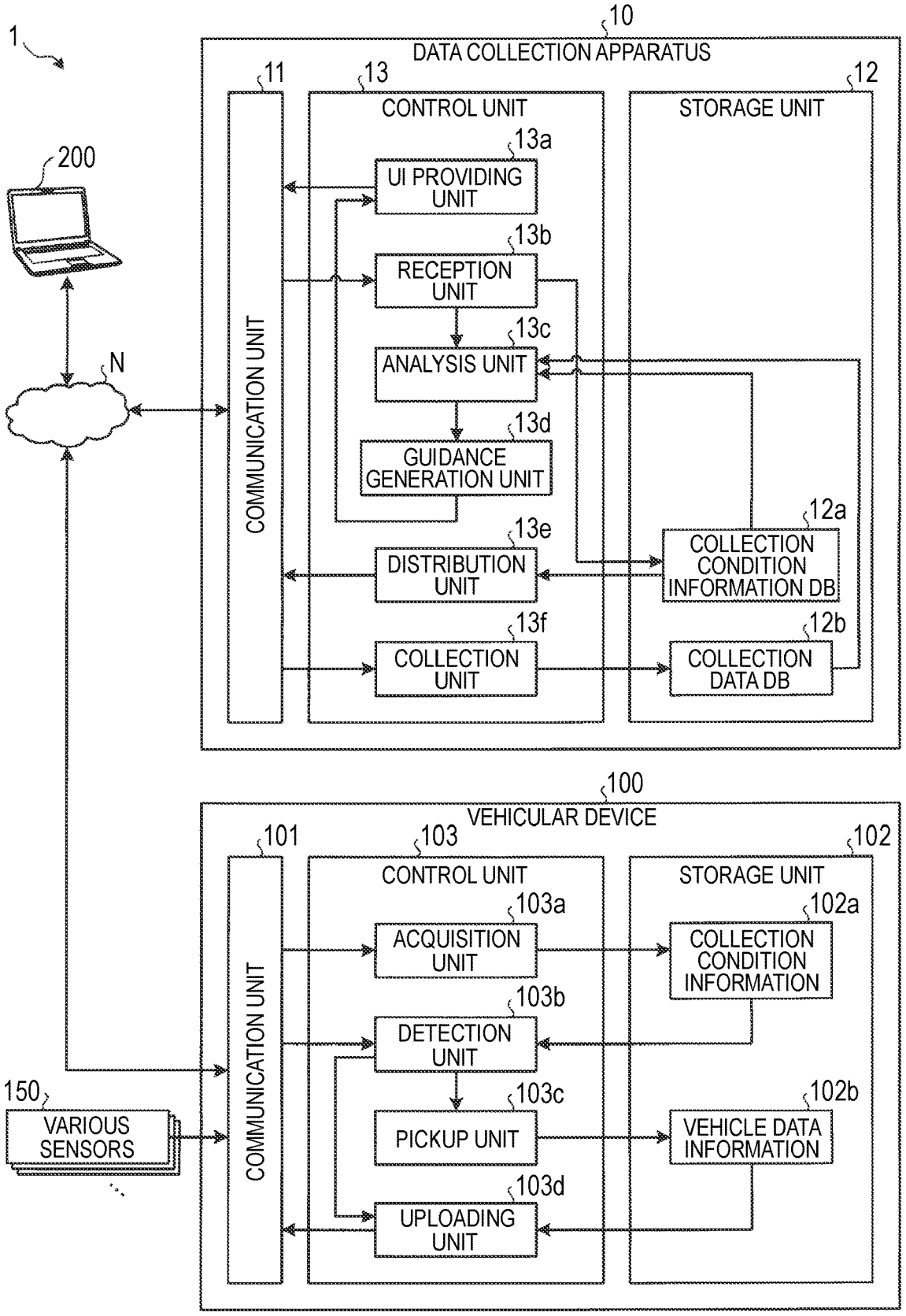
FIG. 2 is a block diagram showing an example configuration of a data collection system according to the embodiment.

FIG. 2 is a block diagram showing an example configuration of the data collection system 1 according to the embodiment. FIG. 2 shows only constituent elements that are necessary for description of features of the embodiment and do not show common constituent elements.

In other words, the constituent elements shown in FIG. 2 are functional and conceptual ones and need not always be the ones shown in FIG. 2 in a physical sense. For example, a specific manner of distribution/integration of the respective blocks is not limited to the one shown in FIG. 2 and all or part of them may be distributed or integrated functionally or physically in desired units according to various kinds of loads, a use situation, and other factors.

In the following description that will be made with reference to FIG. 2, constituent elements that have already been described may not be described at all or may be described only briefly.

As shown in FIG. 2, the data collection system 1 according to the embodiment includes the data collection apparatus 10, the vehicular devices 100, and the user terminal 200.

The data collection apparatus 10 will be described first, which is equipped with a communication unit 11, a storage unit 12, and a control unit 13.

For example, the communication unit 11 is implemented as an NIC (network interface card). Connected to a network N by wire or wirelessly, the communication unit 11 exchanges information with the vehicular devices 100 and the user terminal 200 over the network N.

The storage unit 12 is implemented as a semiconductor memory device such as RAM (random access memory) or a flash memory or a storage device such as a hard disk drive or an optical disc. In the example of FIG. 2, the storage unit 12 stores a collection condition information DB 12*a* and a collection data DB 12*b*.

Collection conditions that have been specified by the user terminal 200 and received by a reception unit 13*b* (described later) are accumulated in the collection condition information DB 12*a*. That is, the collection condition information DB 12*a* contains past results of collection conditions.

Collection data that have been collected from the vehicular devices 100 by a collection unit 13*f* (described later) are accumulated in the collection data DB 12*b*. That is, the collection data DB 12*b* contains tag data T and real data R (described above).

The control unit 13 is a controller and is implemented in such a manner that a CPU (central processing unit), an MPU (microprocessing unit), or the like runs various programs stored in an internal storage device of the data collection apparatus 10 using a RAM as a working area. The control unit 13 can be implemented by an integrated circuit such as an ASIC (application-specific integrated circuit) or an FPGA (field programmable gate array).

The control unit 13 is equipped with a UI providing unit 13*a*, the reception unit 13*b*, an analysis unit 13*c*, a guidance generation unit 13*d*, a distribution unit 13*e*, and the collection unit 13*f* and performs or realizes information processing functions and workings described later.

The UI providing unit 13*a* generates a collection condition setting picture and various UI pictures relating to data collection and provides them to the user terminal 200 via the communication unit 11. Specific examples of the UI pictures will be described later with reference to FIGS. 3A and 3B. Furthermore, the UI providing unit 13*a* provides guidance information generated by the guidance generation unit 13*d* (described later) in such a manner that it is included in a UI picture.

The guidance information contains a communication amount calculated by the analysis unit 13*c* (described later) on the basis of a collection condition specified by the data user through the user terminal 200. The UI providing unit 13*a* may inform, together with the calculated communication amount, the data user of a relationship between the thus-calculated communication amount and a data collection period and the number of collection target vehicles V, for example, may communicate, to the data user, information that data collection will take Y hours when the number of collection target vehicles V is equal to X.

This allows the data user to easily recognize not only the communication amount but also a necessary collection period and number of target vehicles V.

The reception unit 13*b* receives, via the communication unit 11, a communication amount upper limit and a collection condition specified by the data user through the user terminal 200 and informs the analysis unit 13*c* of them. Furthermore, the reception unit 13*b* stores the collection condition specified by the data user in the collection condition information DB 12*a*.

When receiving, for example, a collection condition that has been changed by the data user so as to fall within a communication amount upper limit, the reception unit 13*b* updates a corresponding collection condition in the collection condition information DB 12*a*.

The analysis unit 13*c* analyzes past similar conditions on the basis of the communication amount upper limit and the collection condition received by the reception unit 13*b*, the collection condition information DB 12*a*, and the collection data DB 12*b*. More specifically, the analysis unit 13*c* extracts past similar conditions that are similar to the collection condition received by the reception unit 13*b* from the collection condition information DB 12*a*. The term "similar conditions" include the same condition.

In doing so, the analysis unit 13*c* retrieves past similar conditions in descending order of similarity from the collection condition information DB 12*a* on the basis of priority ranks that are correlated with respective items of the collection condition. This will be described later with reference to FIGS. 4A-4C.

If a similar condition has been extracted, the analysis unit 13*c* calculates a data amount of collection data to be collected under this similar condition on the basis of the collection data DB 12*b*. Then the analysis unit 13*c* calculates a communication amount by multiplying together the calculated data amount, the number of target vehicles V, and a collection period and informs the guidance generation unit 13*d* of the calculated communication amount.

If no similar condition has been extracted, the analysis unit 13*c* informs the guidance generation unit 13*d* of an item of the collection condition that enables extraction of a similar condition(s) with a lower degree of alteration.

If a similar condition has been extracted but a calculated communication amount exceeds a communication amount upper limit, the analysis unit 13*c* searches for conditions under which the communication amount comes to fall within the communication amount upper limit with lower degrees of alteration and informs the guidance generation unit 13*d* of a search result. In other words, if a communication amount that occurs with an extracted similar condition exceeds a communication amount upper limit, the analysis unit 13*c* extracts other similar conditions under which the communication amount comes to fall within the communication amount upper limit in descending order of the degree of alteration and causes the UI providing unit 13*a* to inform the data user of them. The analysis unit 13*c* may list up plural such similar conditions and inform the data user of them in a form like the packages of recommendable condition formulae shown in FIG. 1H.

The guidance generation unit 13*d* generates guidance information relating to a collection condition on the basis of the analysis result communicated from the analysis unit 13*c* and informs the UI providing unit 13*a* of it (the guidance generation unit 13*d* does so also in a case of causing the data user to change the collection condition). For example, the guidance generation unit 13*d* generates guidance information so that guidance on changing of the collection condition as shown in FIG. 1H is displayed.

The distribution unit 13*e* distributes a set collection condition stored in the collection condition information DB 12*a* to target vehicles V in, for example, a file form via the communication unit 11. The collection unit 13*f* collects, via the communication unit 11, vehicle data that are uploaded from the vehicular devices 100 and accumulates them in the collection data DB 12*b*.

Next, each vehicular device 100 will be described, which is equipped with a communication unit 101, a storage unit 102, and a control unit 103. As described above, various sensors 150 such as a camera, an acceleration sensor, and a GPS sensor are connected to the vehicular device 100.

Like the communication unit 11, the communication unit 101 is implemented as an NIC, for example. The communication unit 101 is connected to the network N wirelessly, and exchanges information with the data collection apparatus 10 over the network N. Furthermore, the communication unit 101 receives output data of the various sensors 150.

Like the storage unit 12, the storage unit 102 is implemented as a semiconductor memory device such as RAM or a flash memory or a storage device such as a hard disk drive or an optical disc. In the example of FIG. 2, the storage unit 102 stores collection condition information 102*a* and vehicle data information 102*b*.

The collection condition information 102*a* is information including a collection condition delivered from the data collection apparatus 10. The vehicle data information 102*b* information including vehicle data picked up by a pickup unit 103*c* (described later). Each piece of vehicle data includes tag data T and real data R (described above).

Like the controller 13, the control unit 103 is a controller and is implemented in such a manner that a CPU, an MPU, or the like runs various programs stored in an internal storage device of the vehicular device 100 using a RAM as a working area. The control unit 103 can be implemented by an integrated circuit such as an ASIC or an FPGA.

Equipped with an acquisition unit 103*a*, a detection unit 103*b*, the pickup unit 103*c*, and an upload unit 103*d*, the control unit 103 performs or realizes information processing functions and workings described later.

The acquisition unit 103*a* acquires a collection condition delivered from the data collection apparatus 10 and stores it as part of the collection condition information 102*a*. The detection unit 103*b* monitors output data of the various sensors 150 and detects occurrence of an event that is defined as a trigger in a collection condition.

For example, when detecting occurrence of an event that is defined as a trigger for pickup of vehicle data in a collection condition, the detection unit 103*b* causes the pickup unit 103*c* to pick up vehicle data. For another example, when detecting occurrence of an event that is defined as a trigger for uploading of vehicle data to the data collection apparatus 10 in a collection condition, the detection unit 103*b* causes the upload unit 103*d* to upload vehicle data.

When a trigger for pickup of vehicle data is detected by the detection unit 103*b*, the pickup unit 103*c* picks up vehicle data from output data of the various sensor 150 and stores them as part of the vehicle data information 102*b*. When a trigger for a stop of pickup of vehicle data is detected by the detection unit 103*b*, the pickup unit 103*c* stops pickup of vehicle data.

When a trigger for uploading of vehicle data is detected by the detection unit 103*b*, the upload unit 103*d* uploads vehicle data of the vehicle data information 102*b* to the data collection apparatus 10.

Figure 3A:
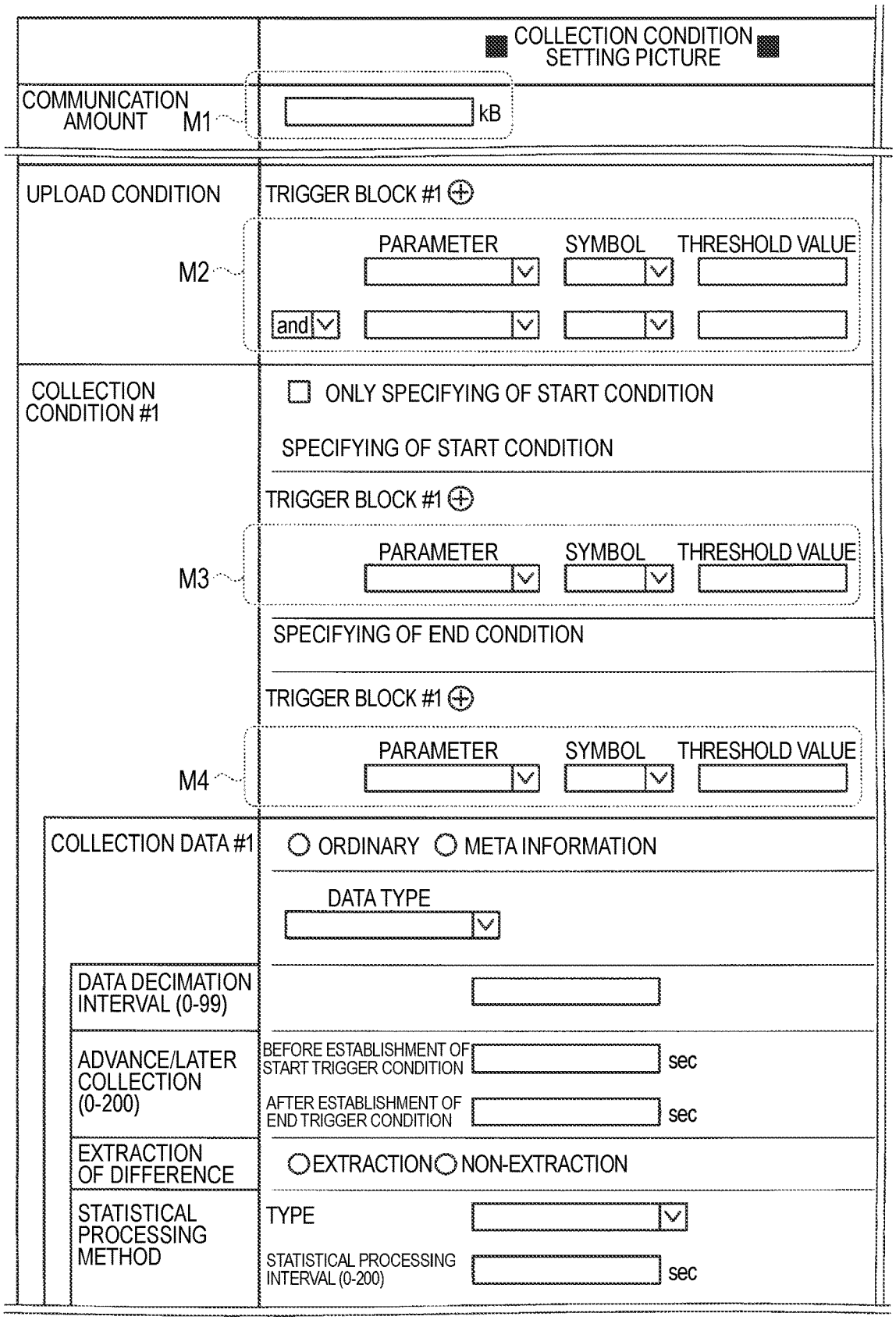
FIG. 3A is a first drawing showing an example collection condition setting picture.
Figure 3B:
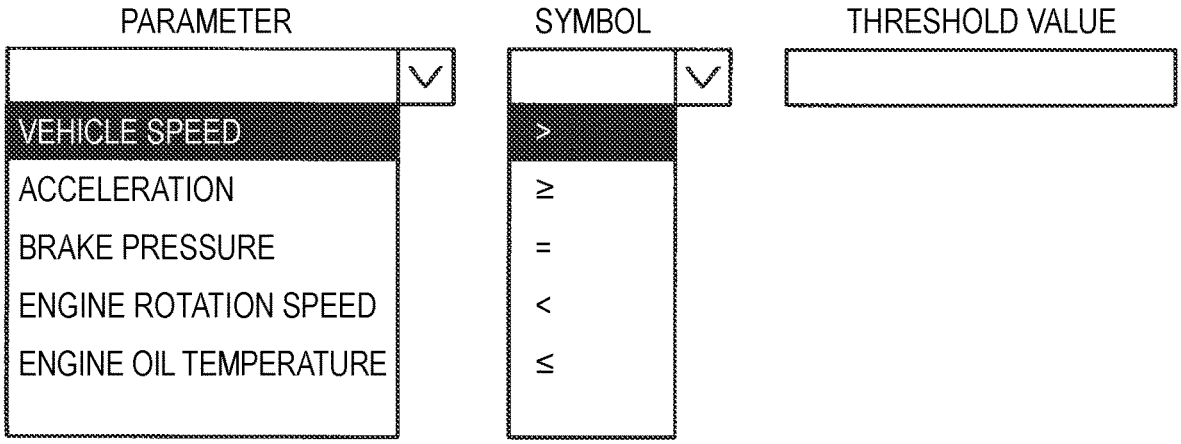
FIG. 3B is a second drawing showing the example collection condition setting picture.

Next, a specific example collection condition setting picture that is provided as a UI picture to the user terminal 200 by the UI providing unit 13*a* will be described will be described with reference to FIGS. 3A and 3B. FIGS. 3A and 3B are first and second drawings showing an example collection condition setting picture.

As shown in part M1 of FIG. 3A, the collection condition setting picture has an item "communication amount upper limit." When the data user inputs a desired communication amount to part M1, the data collection apparatus 10 performs guidance on setting of a collection condition so that the communication amount falls within the thus-specified value.

The collection condition setting picture also has "trigger block" items that enable specifying of condition formulae as triggers of uploading of vehicle data (part M2), a start of pickup (part M3), and an end of pickup (part M4).

In these items, as shown in FIG. 3B, a parameter or a symbol of a condition formula can be selected using a dropdown list of a GUI widget. Whereas it is possible to specify a threshold value by, for example, direct input, each trigger block item may be formed so that a threshold value can be specified using, for example, a dropdown list like a parameter and a symbol.

As shown in FIG. 3A, such a trigger block item can be added by pushing a "+" button. When such a trigger block item is added, a portion for input of a Boolean operator such as "and" or "or" is displayed to enable setting of a logic condition (see part M2 in FIG. 3A). This enables detection of occurrence of a trigger event using a composite condition.

As shown in FIG. 3A, in the collection condition setting picture, it is possible to specify a more detailed condition for collection of data. For example, "ordinary" and "meta information" between which selection can be made using, for example, a radio button of a GUI widget correspond to real data R and data T (described above), respectively.

A "data type" is an accelerator position, for example. A sampling interval can be specified using an item "data decimation interval" and data collection before a start trigger or after an end trigger can be set using an item "advance/later collection."

Whether to pick up data of only a difference bit length from preceding data can be set using an item "extraction of difference." A condition that statistical processing should be performed using average values, maximum values, or the like can be set using an item "statistical processing method." Using these items, the data user can set a collection condition flexibly that is suitable for a purpose.

Figure 4C:
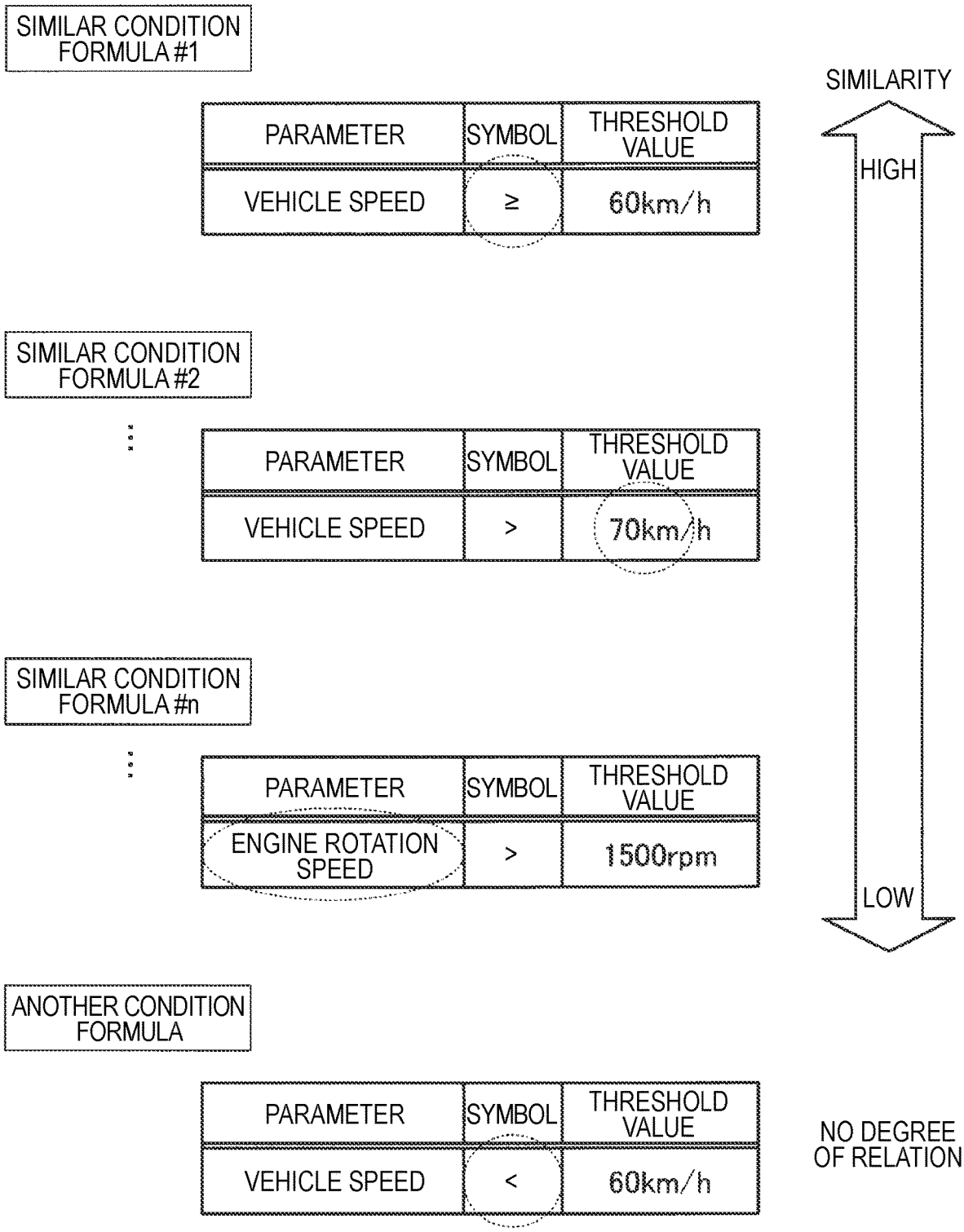
FIG. 4C is a third drawing for description of the similar condition search operation.

Next, a feature that the analysis unit 13*c* searches the collection condition information DB 12*a* for past similar conditions in descending order of similarity will be described with reference to FIGS. 4A-4C. FIGS. 4A-4C are first to third drawings for description of a similar condition search operation.

As a premise of the description, it is assumed that a condition formula shown in FIG. 4A has been specified in a trigger block described above.

The analysis unit 13*c* gives weights (degrees of relation) to respective items that are specified for each of "parameter," "symbol," and "threshold value" of the trigger block. In the following description, where degrees of relation or priority ranks are denoted by alphabetical characters such as "A" to "F," it is assumed that the degree of relation or the priority rank is higher on the "A" side. Where degrees of relation are denoted by symbols "Δ" and "×," it is assumed that the degree of relation of "Δ" is higher than that of "×."

More specifically, where the condition formula shown in FIG. 4A is specified, as shown in FIG. 4B the analysis unit 13*c* sets degrees of relation "A," "B," "C," and "F" for specified parameters (specified values) "vehicle speed," "acceleration," "engine rotation speed," "brake pressure," and "engine oil temperature," respectively.

With respect to the specified symbol (specified value) ">," the analysis unit 13*c* sets a degree of relation "Δ" for a specified symbol "≥" and sets a degree of relation "×" for specified symbols "=," "<," and "≤."

Furthermore, with respect to the specified threshold value "60," the analysis unit 13*c* sets a degree of relation "Δ" for specified values "50" and "70" that are close to it and sets a degree of relation "×" for specified values "40" and "80."

In addition to the above settings, the analysis unit 13*c* sets priority ranks for the items "parameter," "symbol," and "threshold value." It is assumed here that, for example, priority ranks "C," "A," and "B" are set for the items "parameter," "symbol," and "threshold value," respectively.

Then the analysis unit 13*c* generates similar condition formulae indicating respective similar conditions in descending order of similarity while varying the specified value in descending order of the priority rank and the degree of relation. Then the analysis unit 13*c* searches the collection condition information DB 12*a* for past similar conditions in descending order of similarity.

For example, according to the priority ranks and the degree of relation shown in FIG. 4B, the analysis unit 13*c* generates, as similar condition formula #1, a condition formula by changing the symbol from ">" to "≥." The analysis unit 13*c* searches the collection condition information DB 12*a* for past similar conditions that satisfy the similar condition formula #1.

If no similar condition is found, for example, the analysis unit 13*c* generates, as similar condition formula #2, a condition formula by changing the threshold value from "60 km/h" to "70 km/h." The analysis unit 13*c* searches the collection condition information DB 12*a* for past similar conditions that satisfy the similar condition formula #2.

If no similar condition is found even if the above operation is performed certain times, the analysis unit 13*c* generates, as similar condition formula #n, a condition formula by changing the parameter from "vehicle speed" to "engine rotation speed" and changing the threshold value accordingly. The analysis unit 13*c* searches the collection condition information DB 12*a* for past similar conditions that satisfy the similar condition formula #n.

If no similar condition is found even if the above operation is performed repeatedly and only a condition formula without a degree of relation remains, the analysis unit 13*c* judges that there is no similar condition.

For example, the degree of relation shown in FIG. 4B may be reflected in the above-described dropdown list (see FIG. 3B) in guiding the data user in changing the collection condition. For example, in urging the data user to change the current specified value, specified value candidates may be listed in such a dropdown list in descending order of the degree of relation.

In other words, the UI providing unit 13*a* provides guidance so as to recommend specified values of an item other than one item of a collection condition according to a specified value specified for the one item. This makes it possible to allow the data user to set another parameter easily according to the content of a parameter specified by the data user.

Another method is possible in which numerical values are set as degrees of relation, an arithmetic operation such as addition is performed on degrees of relation of respective items, and similarity judgment, for example, is made on the basis of addition results. For example, numerical values indicating degrees of relation are set in such a manner that a value "1" is set for coincidence and a value "0" is set for a very weak relationship, degrees of relation of respective items are added up, and a combination having a largest addition result is employed (e.g., candidates are set in descending order of the addition result and the same processing as described above is performed). In this case, setting a cutoff arithmetic operation value is effective; for example, arithmetic operation values smaller than or equal to 0.6 are not employed because of lack of reliability.

Figure 5:
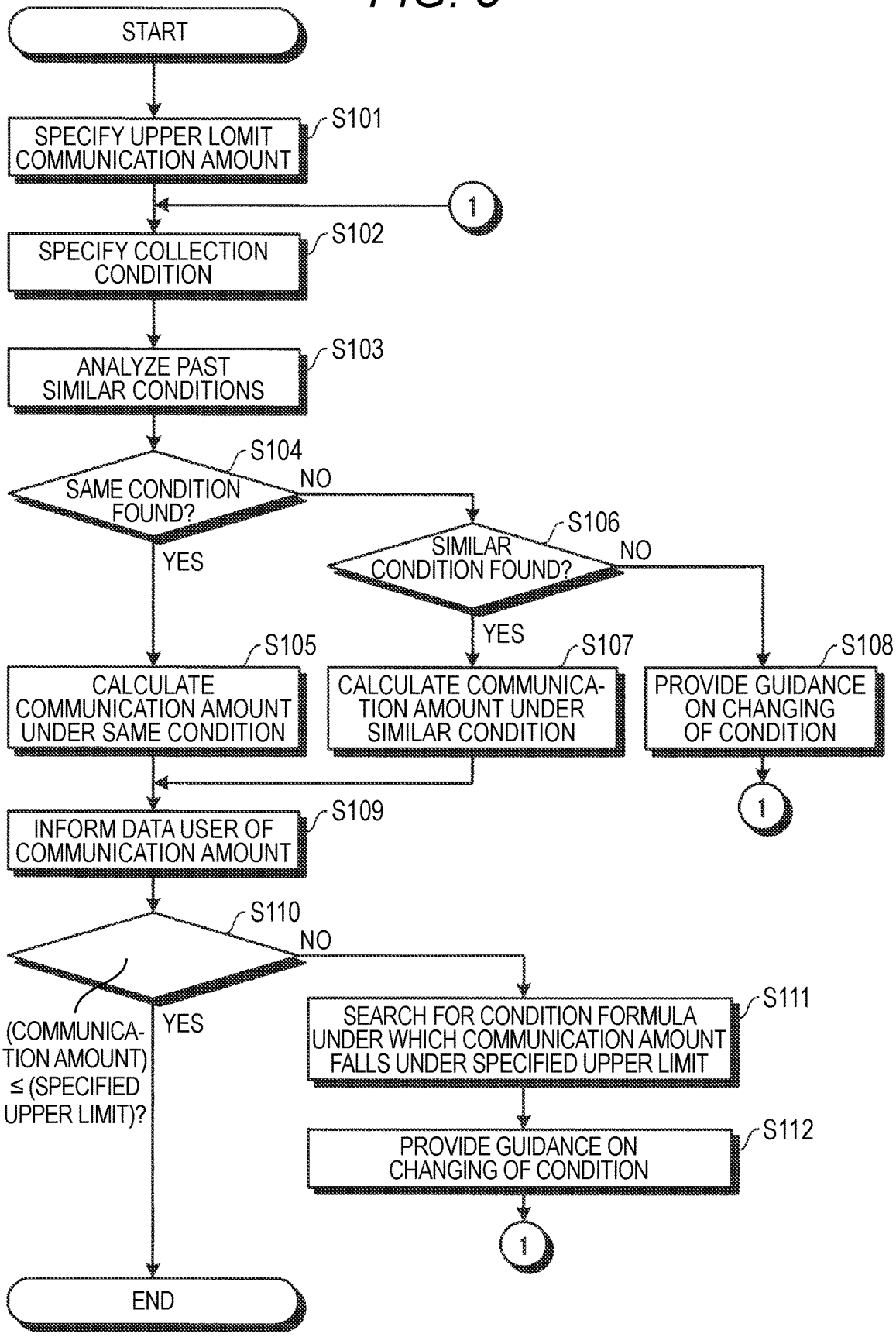
FIG. 5 is a flowchart of a process that is executed by the data collection system according to the embodiment.

Next, a process that is executed by the data collection system 1 according to the embodiment will be described with reference to FIG. 5. FIG. 5 is a flowchart of the process that is executed by the data collection system 1 according to the embodiment.

First, at step S101, the data user specifies an upper limit communication amount through the user terminal 200. At step S102, the data user specifies a collection condition through the user terminal 200.

At step S103, the analysis unit 13*c* of the data collection apparatus 10 analyses past similar conditions. If the same condition is found (S104: yes), at step S105 the analysis unit 13*c* calculates a communication amount to occur under the same condition.

If the same condition is not found (S104: no), the analysis unit 13*c* searches for similar conditions (not the same condition) in descending order of similarity. If a similar condition is found (step S106: yes), at step S107 the analysis unit 13*c* calculates a communication amount under the similar condition.

If no similar condition comes to be found after searching for similar conditions in descending order of similarity (S106: no), at step S108 the guidance generation unit 13*d* generates guidance information and the UI providing unit 13*a* provides guidance on changing of the condition on the basis of the generated guidance information. Then the process returns to step S102.

On the other hand, if a communication amount is calculated at step S105 or S107, at step S109 the UI providing unit 13*a* informs the data user of the communication amount. Where the communication amount was calculated under a similar condition, it is desirable to inform the data user of that fact and the similar condition used for the calculation of the communication amount.

If the communication amount is smaller than or equal to the specified upper limit (S110: yes), the process is finished. On the other hand, if the communication amount is larger than the specified upper limit (S110: no), at step S111 the analysis unit 13*c* searches for a condition formula under which the communication amount falls within the specified upper limit.

At step S112, the guidance generation unit 13*d* generates guidance information on the basis of a result of the search and the UI providing unit 13*a* provides guidance on changing of the condition on the basis of the generated guidance information. Then the process returns to step S102.

As described above, the data collection apparatus 10 according to the embodiment is equipped with the collection unit 13*f*, the reception unit 13*b*, and the UI providing unit 13*a* (an example of the "providing unit"). The collection unit 13*f* collects data relating to respective vehicles V from vehicular devices 100 installed in the respective vehicles V. The reception unit 13*b* receives a prescribed communication amount specified. The UI providing unit 13*a* provides a user interface that provides guidance on manipulations for specifying a data collection condition so that a communication amount of data collected by the collection unit 13*f* falls within the specified communication amount.

Configured as described above, the data collection apparatus 10 according to the embodiment allows the data user to set parameters for information collection easily while recognizing a communication amount.

The data collection apparatus 10 according to the embodiment is further equipped with the analysis unit 13*c* which analyzes results obtained under past collection conditions. The reception unit 13*b* receives a collection condition specified by the data user (an example of the "user") together with the specified communication amount. The analysis unit 13*c* extracts, from the results, a similar condition that is a past collection condition similar to the collection condition received by the reception unit 13*b*, and calculates a communication amount to occur under the similar condition. The UI providing unit 13*a* informs the data user of the communication amount to occur under the similar condition calculated by the analysis unit 13*c*.

With these features, the data collection apparatus 10 according to the embodiment can estimate a proper communication amount on the basis of past results and informs the data user of them.

The analysis unit 13*c* extracts a similar condition according to priority ranks that are set for respective items of the collection condition and degrees of relation of specified values, specified by the data user, of each item.

With this feature, since a similar condition is extracted according to priority ranks and degrees of relation instead of a mere degree of coincidence with the collection condition, the data collection apparatus 10 according to the embodiment can extract a similar condition that is substantially equivalent to the collection condition specified by the data user.

If the communication amount to occur under the similar condition is higher than the specified communication amount, the analysis unit 13*c* extracts other similar conditions under which communication amounts to occur will fall within the specified communication amount in descending order of the degree of alteration and causes the UI providing unit 13*a* to inform the data user of the other similar conditions extracted.

With this feature, the data collection apparatus 10 according to the embodiment can present, to the data user, other similar conditions under which the communication amount will fall within the specified communication amount.

The UI providing unit 13*a* provides guidance about specified values of an item other than one item of the collection condition according to a specified value of the one item.

With this feature, the data collection apparatus 10 according to the embodiment can cause the data user to easily set other parameters according to the content of a parameter specified by the data user.

The UI providing unit 13*a* informs the data user of relationships between the communication amount to occur under the similar condition and a data collection period and the number of collection target vehicles V together with the communication amount to occur under the similar condition.

With this feature, the data collection apparatus 10 according to the embodiment allows the data user to recognize a necessary collection period and the number of necessary target vehicles V easily.

The UI providing unit 13*a* informs the data user of a relationship between the specified communication amount and the communication amount to occur under the similar condition.

With this feature, the data collection apparatus 10 according to the embodiment allows the data user to easily recognize a relationship between the specified communication amount and the communication amount to occur under the similar condition.

In the above-described embodiment, if a similar condition that is similar to a specified collection condition is found, the analysis unit 13*c* calculates a data amount of collection data to be collected under the similar condition and calculates a communication amount by multiplying the calculated data amount by the number of target vehicles and a collection period. However, the method for calculating a communication amount is not limited to this method.

For example, the analysis unit 13*c* may calculate, by performing a simulation, a data amount corresponding to a collection condition specified by the data user on the basis of past results in the collection condition information DB 12*a* and the collection data DB 12*b* in a prescribed period and calculate a communication amount on the basis of the calculated data amount.

For another example, the analysis unit 13*c* may generate a learning model of performing machine learning such as deep learning on the basis of past results in a prescribed period existing in the collection condition information DB 12*a* and the collection data DB 12*b* and, when a desired collection condition is input, outputting a data amount and a communication amount corresponding to the collection condition.

Furthermore, although in the above-described embodiment the data user is, for example, a developer of an autonomous drive technique, this is just an example; the data user may be a corporation such as a service provider or a general individual.

Those skilled in the art would easily conceive other advantages and modifications. Thus, broader modes of the invention are not limited to the above-described particular, detailed, and typical embodiment. Various modifications are therefore possible without departing from the spirit and scope of a generalized inventive concept that is defined by the claims and their equivalents.

DESCRIPTION OF SYMBOLS

1: Data collection system
10: Data collection apparatus
12*a*: Collection condition information DB
12*b*: Collection data DB
13*a*: UI providing unit
13*b*: Reception unit
13*c*: Analysis unit
13*d*: Guidance generation unit
13*e*: Distribution unit
13*f*: Collection unit
100: Vehicular device
102*a*: Collection condition information
102*b*: Vehicle data information
103*a*: Acquisition unit
103*b*: Detection unit
103*c*: Pickup unit
103*d*: Upload unit
150: Various sensors
200: User terminal
V: Vehicle

What is claimed is:

1. A data collection apparatus that collects data from a plurality of vehicles, the apparatus comprising a hardware processor configured to:

collect the data over a network from drive recorders installed in the plurality of vehicles, the drive recorders recording data from sensors installed in the vehicles, the sensors including one or more of acceleration sensors and GPS sensors;

receive a prescribed data communication amount specified by a user, the prescribed data communication amount being a maximum quantity of the data to be collected from the plurality of vehicles over the network; and provide a user interface on a display screen, the user interface providing the user with guidance on specifying at least one data collection condition for collecting the data from the plurality of vehicles, the at least one data collection condition identifying one or more of (i) target vehicles of the plurality of vehicles from which the data is to be collected, (ii) collection trigger conditions that cause the data to be collected from the vehicles, (iii) a data collection period over which the data is collected from the vehicles, and (iv) a type of the data to be collected, the guidance suggesting values of the at least one data collection condition that will result in an amount of the data collected from the vehicles over the network to be less than or equal to the prescribed data communication amount that was specified by the user.

2. The data collection apparatus according to claim 1, wherein the hardware processor is further configured to analyze results of previously-conducted data collection processes, and wherein:

the hardware processor receives a designated data collection condition specified by the user together with the prescribed data communication amount;

the hardware processor extracts, from the results of the previously-conducted data collection processes, a previously-used similar data collection condition that is similar to the designated data collection condition, and calculates an estimated data communication amount that is estimated to occur using the previously-used similar data collection condition; and the hardware processor informs the user of the estimated data communication amount that was calculated.

3. The data collection apparatus according to claim 2, wherein the hardware processor extracts the previously-used similar data collection condition according to priority ranks that are set for a plurality of previously-used similar data collection conditions and degrees of similarity of the previously-used similar data collection conditions, to the designated data collection condition specified by the user.

4. The data collection apparatus according to claim 3, wherein, when the estimated data communication amount that is estimated to occur under the similar data collection condition is higher than the prescribed data communication amount specified by the user, the hardware processor extracts other similar data collection conditions under which estimated data communication amounts will be less than or equal to the prescribed data communication amount in descending order of a degree of alteration and informs the user of the other similar data collection conditions that have been extracted.

5. The data collection apparatus according to claim 4, wherein the hardware processor informs the user of a relationship between the prescribed data communication amount specified by the user and the estimated data communication amount estimated to occur under the similar data collection condition.

6. The data collection apparatus according to claim 3, wherein the hardware processor provides guidance about a specified value of a different data collection condition other than the at least one data collection condition designated by the user according to a specified value of the at least one data collection condition designated by the user.

7. The data collection apparatus according to claim 3, wherein the hardware processor informs the user of relationships between the estimated data communication amount estimated to occur under the similar data collection condition and a data collection period and a number of collection target vehicles for the estimated data communication amount.

8. The data collection apparatus according to claim 3, wherein the hardware processor informs the user of a relationship between the prescribed data communication amount specified by the user and the estimated data communication amount estimated to occur under the similar data collection condition.

9. The data collection apparatus according to claim 2, wherein, when the estimated data communication amount that is estimated to occur under the similar data collection condition is higher than the prescribed data communication amount specified by the user, the hardware processor extracts other similar data collection conditions under which estimated data communication amounts will be less than or equal to the prescribed data communication amount in descending order of a degree of alteration and informs the user of the other similar data collection conditions that have been extracted.

10. The data collection apparatus according to claim 9, wherein the hardware processor provides guidance about a specified value of a different data collection condition other than the at least one data collection condition designated by the user according to a specified value of the at least one data collection condition designated by the user.

11. The data collection apparatus according to claim 9, wherein the hardware processor informs the user of relationships between the estimated data communication amount estimated to occur under the similar data collection condition and a data collection period and a number of collection target vehicles for the estimated data communication amount.

12. The data collection apparatus according to claim 9, wherein the hardware processor informs the user of a relationship between the prescribed data communication amount specified by the user and the estimated data communication amount estimated to occur under the similar data collection condition.

13. The data collection apparatus according to claim 2, wherein the hardware processor provides guidance about a specified value of a different data collection condition other than the at least one data collection condition designated by the user according to a specified value of the at least one data collection condition designated by the user.

14. The data collection apparatus according to claim 2, wherein the hardware processor informs the user of relationships between the estimated data communication amount estimated to occur under the similar data collection condition and a data collection period and a number of collection target vehicles for the estimated data communication amount.

15. The data collection apparatus according to claim 2, wherein the hardware processor informs the user of a relationship between the prescribed data communication amount specified by the user and the estimated data communication amount estimated to occur under the similar data collection condition.

16. The data collection apparatus according to claim 1, wherein the hardware processor provides guidance about a specified value of a different data collection condition other than the at least one data collection condition designated by the user according to a specified value of the at least one data collection condition designated by the user.

17. The data collection apparatus according to claim 1, wherein the hardware processor informs the user of relationships between an estimated data communication amount estimated to occur under a similar data collection condition and a data collection period and a number of collection target vehicles for the estimated data communication amount.

18. The data collection apparatus according to claim 1, wherein the hardware processor informs the user of a relationship between the prescribed data communication amount specified by the user and an estimated data communication amount estimated to occur under a similar data collection condition.

19. A data collection system comprising:

the data collection apparatus according to claim 1;

the drive recorders; and a terminal device which is provided with the user interface through which the user specifies the prescribed data communication amount and the at least one data collection condition.

20. A data collection method of collecting data from a plurality of vehicles, the method implemented by a hardware processor and comprising:

collecting the data over a network from drive recorders installed in the plurality of vehicles, the drive recorders recording data from sensors installed in the vehicles, the sensors including one or more of acceleration sensors and GPS sensors;

receiving a prescribed data communication amount specified by a user, the prescribed data communication amount being a maximum quantity of the data to be collected from the plurality of vehicles over the network; and providing a user interface on a display screen, the user interface providing the user with guidance on specifying at least one data collection condition for collecting the data from the plurality of vehicles, the at least one data collection condition identifying one or more of (i) target vehicles of the plurality of vehicles from which the data is to be collected, (ii) collection trigger conditions that cause the data to be collected from the vehicles, (iii) a data collection period over which the data is collected from the vehicles, and (iv) a type of the data to be collected, the guidance suggesting values of the at least one data collection condition that will result in an amount of the data that is collected by the collecting from the vehicles over the network to be less than or equal to the prescribed data communication amount that was specified by the user.

* * * * *